US006247388B1

(12) United States Patent
Carter et al.

(10) Patent No.: US 6,247,388 B1
(45) Date of Patent: Jun. 19, 2001

(54) APPARATUS AND METHOD USING A LOCK-IN AMPLIFIER IN THE CONTROL OF A PERIODIC FORCE APPLIED TO A MOVING PART

(75) Inventors: David Christopher Miller Carter; Peter Nicholas Collett, both of Coventry (GB)

(73) Assignee: Molins PLC, Milton Keynes (GB)

( * ) Notice: Subject to any disclaimer, the term of this patent is extended or adjusted under 35 U.S.C. 154(b) by 0 days.

(21) Appl. No.: 09/171,222

(22) PCT Filed: Apr. 17, 1997

(86) PCT No.: PCT/GB97/01064

§ 371 Date: Jan. 8, 1999

§ 102(e) Date: Jan. 8, 1999

(87) PCT Pub. No.: WO97/39395

PCT Pub. Date: Oct. 23, 1997

(30) Foreign Application Priority Data

Apr. 17, 1996 (GB) ..... 9607905

(51) Int. Cl.[7] ..... B26D 5/00

(52) U.S. Cl. ..... 83/13; 83/76.1; 83/557; 83/575; 310/316.01

(58) Field of Search ..... 83/701, 956, 557, 83/575, 13, 76.1; 310/316.01; 318/116

(56) References Cited

U.S. PATENT DOCUMENTS

| | | | | |
|---|---|---|---|---|
| 3,817,141 | * | 6/1974 | Simonetti | 83/701 |
| 3,873,859 | * | 3/1975 | Shoh | 310/316.01 |
| 4,685,602 | * | 8/1987 | Hama | 83/701 |
| 4,687,962 | * | 8/1987 | Elbert | 310/316.01 |
| 4,747,895 | * | 5/1988 | Wallerstein et al. | 83/660 |
| 4,882,525 | * | 11/1989 | Cordemans De Meulenaer et al. | 310/316 |
| 5,101,599 | * | 4/1992 | Takabayasi et al. | 83/701 |
| 5,226,343 | * | 7/1993 | Rawson et al. | 83/701 |
| 5,768,970 | * | 6/1998 | Wolf et al. | 83/701 |
| 5,934,043 | * | 8/1999 | Aindow et al. | 83/956 |

* cited by examiner

*Primary Examiner*—Rinaldi I. Rada
*Assistant Examiner*—Kim Ngoc Tran
(74) *Attorney, Agent, or Firm*—Antonelli, Terry, Stout & Kraus, LLP

(57) ABSTRACT

An application for periodically applying a controllable force to a movable part has a force applying member, particularly for cutting a web, and a driver for driving the force applying member. The driver is controlled by a force-indicating signal produced by a lock-in amplifier to which a force-responsive signal and a reference signal are inputted. The lock-in amplifier operates to eliminate or reduce any noise present in the force-responsive signal.

15 Claims, 4 Drawing Sheets

APPARATUS AND METHOD USING A LOCK-IN AMPLIFIER IN THE CONTROL OF A PERIODIC FORCE APPLIED TO A MOVING PART

This invention is concerned particularly with the control of apparatus for cutting at regular intervals a web such as, for example, used for joining cigarettes to filters in a filter attachment machine. Web cutting in this context involves cooperation at regular intervals between two members at least one of which preferably rotates. Cutting may, for example, be achieved by a crushing action between a knife on one member and an anvil on the other member. Alternatively, cutting may be achieved ultrasonically, for example as described in our PCT patent application WO 94/14583 (case 3643).

In both crush cutting and ultrasonic cutting it is desirable to control the relative positions of the two members which cooperate to perform each cut in order to achieve a sufficient but not excessive cutting force. The present invention is concerned particularly with an automatic control system for use particularly in such web cutting arrangements.

Apparatus according to this invention for periodically applying a controllable force to a moving part (for example a web of paper to be cut) comprises a force-applying member, and means for producing a control electrical signal indicative of the force applied by the force-applying member and for controlling the force applying member so as to control the force applied by it to the moving part, the control signal being produced with the aid of a lock-in amplifier to which is applied a force-responsive electrical signal together with a reference signal, whereby any noise element in the control signal is eliminated or reduced by the lock-in amplifier.

By this means, despite the noise which almost inevitably accompanies the signals from a sensor, for example in this context, the average cutting force of the force generated at each cut (for example) can be obtained to enable the position of one of the cutting members to be adjusted in order to achieve a desired level of cutting force. For example, in apparatus for cutting a filter attachment web (commonly termed "cork paper"), the cutting members can be set at positions such that, in the absence of the web, there would be merely light contact between the cutting members; thus the presence of the web during use results in a significant but not excessive force being applied sufficient to cut the web, whether this is achieved by an ultrasonically driven cutting member or by means of a simple crush cutting operation as used conventionally in connection with cork cutting in a filter attachment machine.

Lock-in amplifiers are known per se and are commercially available. For example, reference is directed to a book entitled "The Art of Electronics" by Paul Horowitz and Winfield Hill, published by Cambridge University Press. In the second edition section 15.15 contains a general description of "Lock-in detection" and some uses thereof. An example of a commercially available lock-in amplifier which may be used in carrying out the present invention is that made by Analog Devices, of 1 Technology Way, P.O. Box 9106, Norwood, Mass. 02062-9106, USA and identified as their AD630 product.

Examples of ultrasonic apparatus for cutting a web of filter attachment paper are shown in the accompanying drawings. In these drawings.

Figure 1:
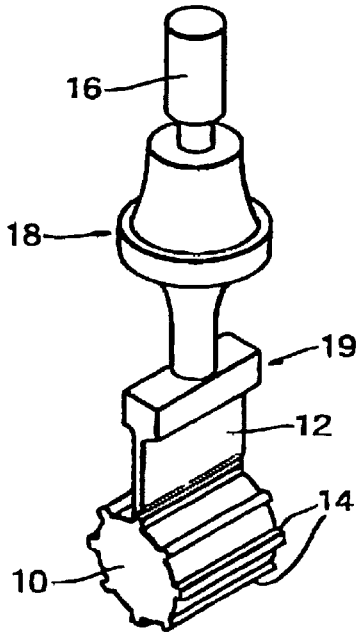
FIG. 1 is a diagrammatic perspective view of one web cutting apparatus.

FIG. 1 shows a drum 10 around which a web of filter attachment paper is to be conveyed and from which leading end portions are severed by means of an ultrasonic cutting arrangement. This cutting arrangement comprises an ultrasonically driven horn 12 which cuts the web in cooperation with slightly raised members 14 mounted at regular intervals around the circumference of the drum 10. The arrangement may more specifically be as described with reference to FIGS. 16 and 17 of our above-mentioned PCT patent application, the raised members 14 being relatively sharp-edged knives while the cooperating surface of the horn 12 serves as an anvil; alternatively, as illustrated by FIG. 1, the members 14 may constitute anvils and the cooperating edge of the horn 12 may effectively constitute a "knife".

The horn 12 is driven ultrasonically so as to vibrate towards and away from the drum 10 by an ultrasonic piezo actuator 16 via a booster 18. In the region 19 there is a node of zero displacement at which the horn may be clamped to support the whole assembly. As a result of the ultrasonic excitation of the piezo actuator, a 60–70 micron displacement at 20 kHz (for example) occurs at the cutting end of the horn 12.

Figure 2:
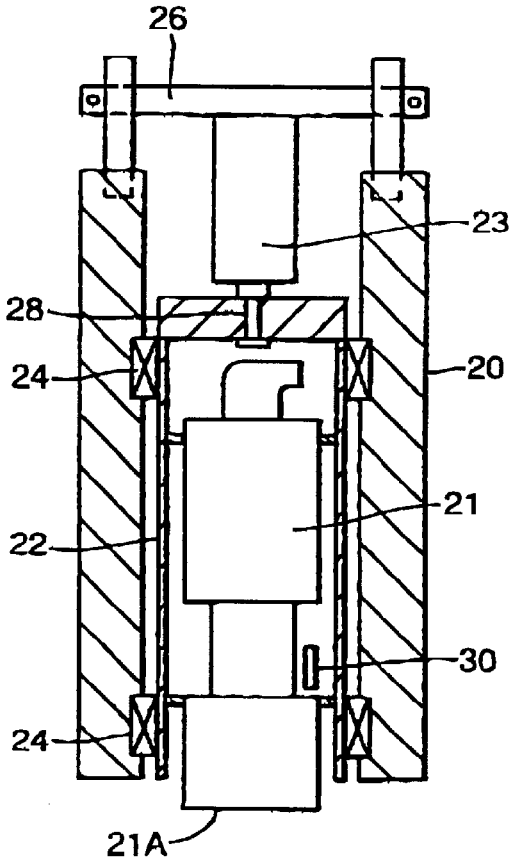
FIG. 2 is a longitudinal section through part of a similar apparatus.

FIG. 2 is a longitudinal section through a housing 20 of a different arrangement including a horn 21 mounted in an inner housing 22 and having a "cutting" edge 21A. The inner housing 22 is slidably mounted in the housing 20 by means of linear bearings 24 (e.g. PTFE) so that the inner housing can move vertically with respect to the main outer housing 20. Such movement is controlled by a device 23, which has a main body carried by a beam 26 mounted on the housing 20, and a movable part 28 extending from its lower end and connected to an end wall of the inner housing 22. By this means, the position of the horn 21 can be finely adjusted. The device 23 may comprise a piezo actuator or translator, for example one of those manufactured by Physik Instrumente (Pl GmbH, D-76337 Waldbronn, Germany), one suitable example being that identified as the LVPZ translator model P-841.30.

The force transmitted to the anvil during each cutting operation is monitored using an electrical signal output by an eddy current sensor 30 mounted inside the inner housing 22 and slightly spaced from an opposed surface of the horn. The electrical signal derived from the sensor 30 is fed to the control circuit shown in FIG. 3.

Figure 3:
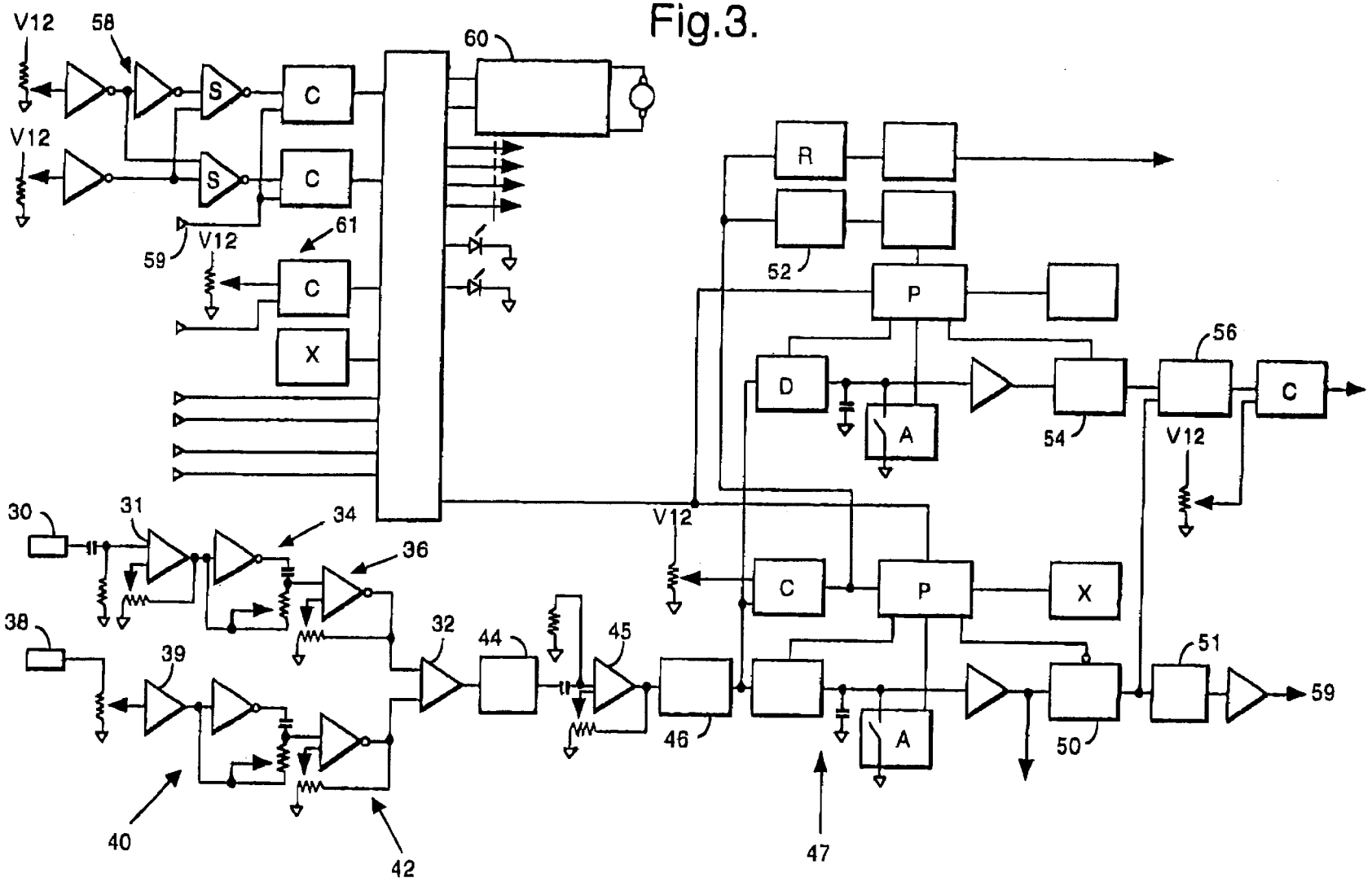
FIG. 3 is a circuit diagram of a control system for the apparatus.

In FIG. 3 certain of the circuit components are identified as follows:

C=Comparator (10% hysteresis)
S=Summation amplifier
P=Programmable logic device
X=Crystal oscillator
R=Retriggerable monostable
A=Analog switch
D=Peak detector.

Figure 4A:
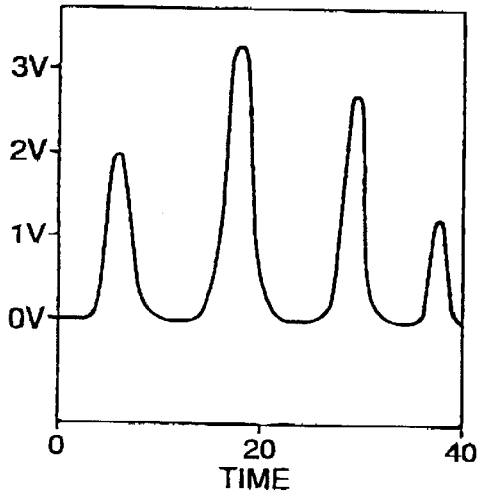
FIGS. 4A–4D are graphs showing various signals produced during use of the apparatus.

With reference to FIG. 3, the analogue voltage output of the eddy current sensor 30 is proportional to the displacement of the horn from the reference plane of the sensor. The first stage of the control circuit conditions the signal output by the sensor, removing the large amounts of noise associated with the signal. This part of the circuit is based around a lock-in amplifier 32. The circuit demodulates the sensor signal with the use of an ultrasonic reference signal and requires a controlled phase difference between the reference and sensor signals. The reference signal is received from a source 38 and is fed via a phase adjusting circuit component 40; there is also a phase adjusting provision 34 in the path from the sensor 30 to the lock-in amplifier. Any necessary signal gains are provided by circuit components 31, 36, 39 and 42. The remaining noise is filtered out by mean of a low pass filter 44. Unwanted portions of the signal are removed by a half-wave rectifier 46 and the gain is adjusted by circuit component 45. A typical waveform of the conditioned sensor signal in shown is FIG. 4A, which depicts peaks of amplitude which are proportional to the displacement of the horn relative to the reference plane of the sensor, and are thus proportional to the force reacted by the anvil.

Figure 4B:
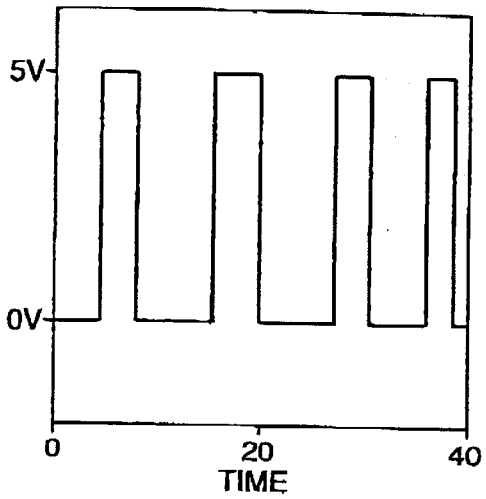

Contact between the knife and anvil is detected when the sensor signal exceeds a pre-determined threshold level. A knife hit envelope signal can then be generated for the period during which the knife and anvil are in contact (see FIG. 4B).

Figure 4C:
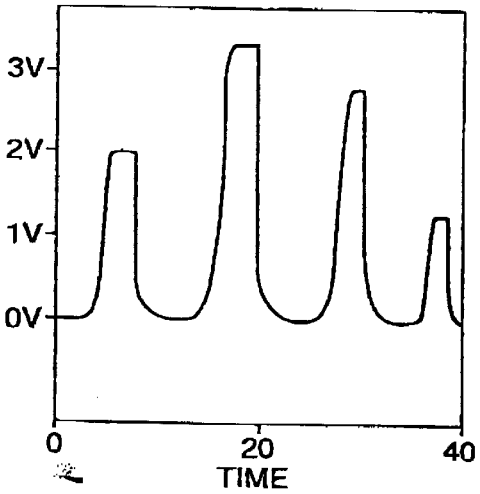

Individual knife/anvil disturbance forces are detected by a peak detector 47 that captures the maximum level of the conditioned sensor signal occurring during the knife hit envelope period (see FIG. 4C). Excessive cutting forces are monitored by circuit component 61 to prevent premature failure to the cutting apparatus through automatic adjustment of the cutting members, or by stopping the machine.

Figure 4D:
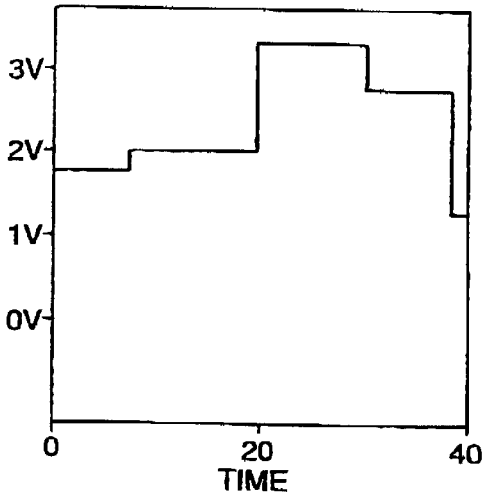

A sample and hold circuit 50 stores the peak of the disturbance signal (corresponding to the force on the anvil at each cutting operation) to produce a maximum disturbance signal (see FIG. 4D). The circuit component 50 stores the disturbance signal obtained during each cut, but is resent once during every revolution of the drum 10 by a circuit component 52; assuming that there are 16 knives on the drum 10, which would be typical in practice, the component 52 would be a/16 component.

A further sample-and-hold circuit 54 stores the maximum signal obtained during each revolution of the drum 10, and a differential amplifier 56 compares each maximum with a reference. The resulting information is used to control a circuit component 58 which drives the piezo actuator 23, the movement produced by the actuator 23 for controlling the position of the horn being proportional to the voltage applied to the actuator. The amount of movement is controlled to keep the disturbance signal within an acceptable range.

FIG. 3 actually shows a motor driver 60 for positioning the horn, which is a possible alternative to the piezo actuator.

The circuit shown in FIG. 3 monitors both the maximum minimum disturbance signals and can be used to keep both within an acceptable range. When the minimum signal, for example, drops below the acceptable range and cannot be brought into the acceptable range by movement of the horn 21, without taking the maximum outside the acceptable range, an alarm signal is produced or alternatively the machine is automatically switched off to allow the knives to be reground or manually adjusted. An average of the disturbances is obtained through smooth of the maximum disturbance signal with a low pass filter 51.

By adjusting the position of the horn assembly, the average cutting force can be controlled by maintaining the average disturbance level at about a fixed value. The circuit component 58 effectively serves as a window comparator, with two threshold values set about a desired fixed value, and this monitors the average disturbance signal. When the level of the average disturbance analog signal strays outside of the window thesholds, the horn actuator is adjusted to restore the average disturbance to within the window. Thus, a substantially constant cutting force can be achieved through maintaining the average disturbance at about a fixed level. The aperture of the window is set to correspond to the required tolerance of the average cutting force variation of the duty cycle capability of the actuator.

Excessive variance of wear between individual knives is monitored to keep both the maximum and minimum disturbances of one cycle within an acceptable range. The maximum disturbance level over one cycle (revolution) of the drum is stored in the sample and hold circuit 54. During the next cycle of the knife drum, the peak disturbance level associated with each cut is compared with the maximum disturbance stored from the previous cycle. The difference between these two signals is then the variation of the cutting disturbances. The circuit provides a means for automatic detection of worn out knives and an indication that the system is outside the limits of automatic adjustment of the cutting apparatus and is therefore no longer able to maintain a consistent quality of cut from all knives.

Instead of the horn 12 being maintained in a set position during each revolution of the drum 10, it may be controlled in position by the piezo actuator so as to produce the required disturbance signal during each cutting operation. This modification would require the actuator to receive a disturbance signal for each individual knife, and to control the position of the anvil during, for example, one sixteenth of a revolution of the drum 10. More specifically, the circuit would need to store the disturbance signal for each knife during one revolution of the drum, so that the horn can be positioned appropriately when the knife next engages the anvil.

A generally similar control circuit may be used to control the position of each knife in a conventional crush-cutting apparatus, for example of the type generally described in U.S. Pat. No. 4,372,327. For this purpose the rotating knife carrier which cooperates with anvil surfaces on the drum would preferably have as many knives as there are anvil surfaces on the drum. The interference between each knife and the corresponding anvil surface on the drum is then adjusted by a piezo actuator controlling the position of the knife carrier. This position may be adjusted gradually in response to the average or maximum disturbance signal detected in this case by a sensor adjacent to the knife carrier or a part carrying the knife carrier. Alternatively, the piezo actuator may be capable of resetting the position of the knife carrier in order to achieve the required interference between each knife and its corresponding anvil. A further possibility in principle is that the knife carrier may include a separate piezo actuator for each knife.

Figure 5:
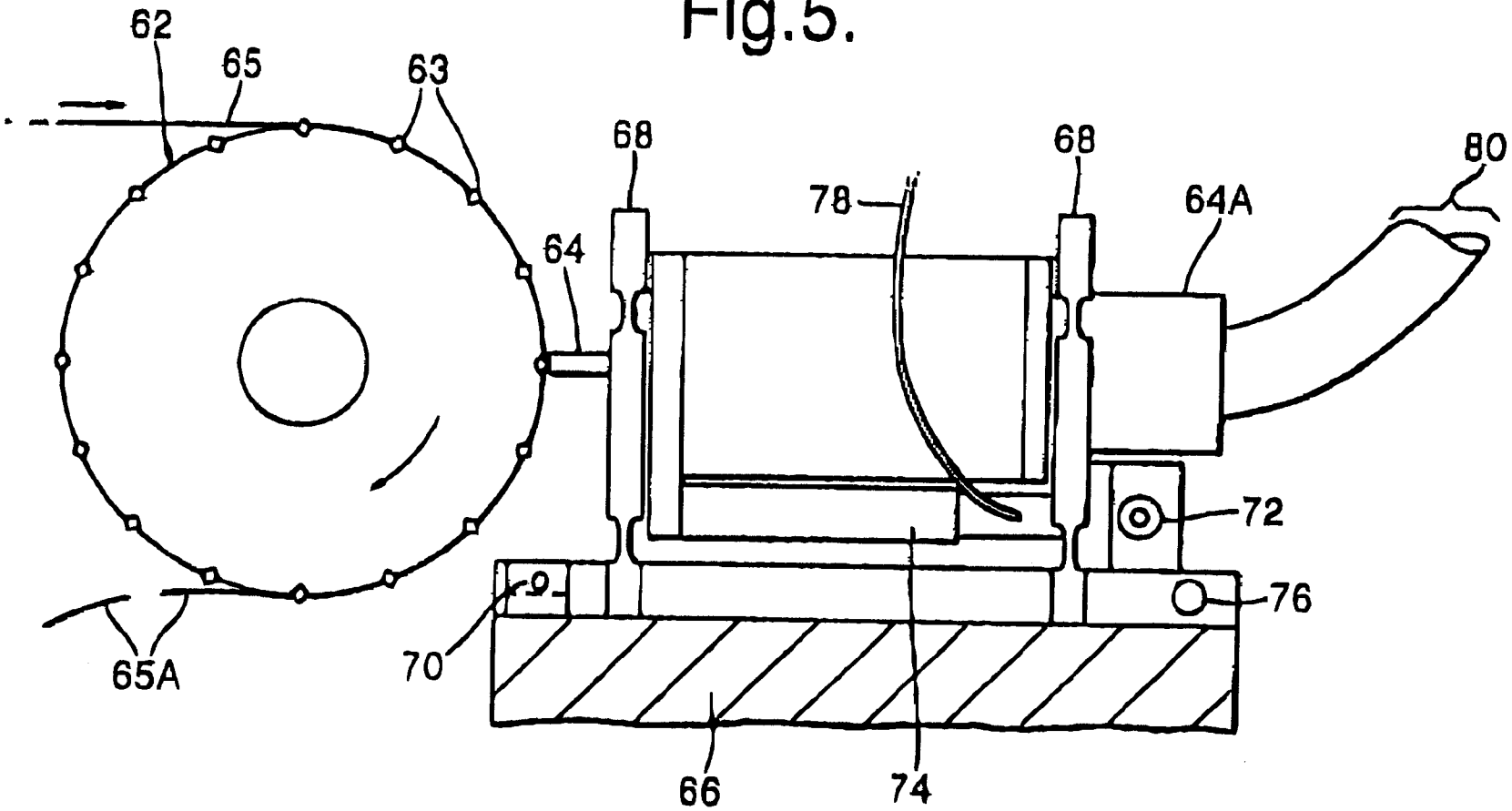
FIG. 5 is a longitudinal section through a modified form of the apparatus.

FIG. 5 shows a different arrangement which includes a cork cutting drum 62 fitted with 16 tungsten carbide knives 63 mounted at regular intervals around the circumference of the drum and presenting knife edges which project from the surface of the drum. An ultrasonic horn 64 serves as an anvil which cooperates with each knife edge to cut the filter attachment "cork" paper (65) as it passes around the drum 60 to produce individual cork patches 65A.

The ultrasonic horn assembly, which is generally referenced 64A, is driven sinusoidally at 20 kHz, its oscillating displacement being amplified by a booster as described with reference to the first example. As a result of the ultrasonic excitation, a 60–70 micron displacement at 20 kHz occurs at the cutting end of the anvil 64.

The ultrasonic horn assembly is mounted on a base 66 by two flexure devices 68 which set the lateral position of the horn assembly while allowing axial displacement. Such axial displacement for adjustment purpose can be made by a coarse adjustment arrangement 70 and by a fine adjustment 72, as well as by a piezo actuator 74. There is also provision for adjusting the squareness of the anvil with respect to the knife drum by means of an adjustment arrangement 76.

The piezo actuator 74 is capable of expanding up to 90 microns and of producing a force of up to 800N. A control circuit such as that shown in FIG. 3 is used to control the actuator 74 in order to achieve the desired level of cutting force between the anvil 64 and each of the knives 62. Connections to the control circuit are made from the piezo actuator 74 by leads 78, and a filtered air supply and electric connection are provided to the horn assembly 64A by means 80.

The following modification has proved to be feasible. The sensor 30 is omitted. Instead, we have found that the force effect during each cutting operation is reflected in the ultrasonic drive signal used to power the ultrasonic horn. Accordingly an input signal to the lock-in amplifier can be tapped off the drive signal. A reference signal can also be tapped off the drive signal and (with suitable phase adjustment) can be applied to the lock-in amplifier.

Another possible modification is as follows: instead of the ultrasonically driven member being adjusted in position to control the force, the force can be controlled at least partly by varying the amplitude of the ultrasonic vibrations.

What is claimed is:

1. A method for periodically applying a controllable force to a moving part by means of a force-applying member, comprising the steps of producing an electrical force-indicating signal which is indicative of the force applied by the force-applying member, and using said force-indicating signal to control said applied force, the force-indicating signal being produced with the aid of a lock-in amplifier to which a force-responsive signal is applied together with a reference signal, whereby any noise element in the force-responsive signal is eliminated or reduced by the lock-in amplifier.

2. A method as claimed in claim 1, including vibrating said force-applying member by means of an ultrasonic drive signal and deriving said force-responsive signal and said reference signal from said drive signal.

3. A cutting apparatus for cutting a moving web, said cutting apparatus comprising:

a web support member for supporting said moving web;

a force-applying member which is periodically driven towards said web support member so as to apply a force to said web whereby the web is crush cut between said force-applying member and said web support member;

a first drive for driving said force-applying member;

a second drive for positioning said force-applying member relative to said web support member; and a control circuit for controlling said second drive whereby to control the force applied by said force applying member to said web, said control circuit including a lock-in amplifier which receives a first signal which is a function of said force applied by said force-applying member and a reference signal, and outputs a second signal which is a function of said force applied by said force-applying member such that any noise present in said first signal is not present or is substantially reduced in said second signal, said control circuit being arranged to use said second signal to control said second drive.

4. Apparatus for periodically applying a controllable force to a moving part, said apparatus comprising a force-applying member, and means for producing an electrical force-indicating signal indicative of the force applied to said moving part by the force-applying member and for controlling the force-applying member using said force-indicating signal so as to control the forces applied by said force-applying member to the moving part, said force-indicating signal being produced with the aid of a lock-in amplifier to which is applied a force-responsive electrical signal together with a reference signal, whereby any noise element in said force-responsive electrical signal is eliminated or reduced by the lock-in amplifier.

5. Apparatus according to claim 1, in which the force-applying member is vibrated, while applying a force to the moving part.

6. Apparatus according to claim 5, in which the force-applying member is vibrated by an ultrasonic device and the force applied to the moving part by the force-applying member is controlled by controlling the amplitude of the ultrasonic vibration.

7. Apparatus as claimed in claim 6, in which said ultrasonic device comprises a piezo actuator.

8. Apparatus according to claim 1, for cutting at regular intervals a moving part in the form of a web, each cut being effected by the force-applying member cooperation with a web support member whereby the web is crushed between the two members.

9. Apparatus according to claim 8, in which the force-responsive signal is produced by a detector arranged to detect displacement of the force-applying member while it is making each cut.

10. Apparatus according to claim 9, in which the detector comprises an eddy current device mounted close to the force-applying member.

11. Apparatus according to claim 8, in which the force-applying member is vibrated ultrasonically by an ultrasonic driver powered by a generator, which the drive signal to the ultrasonic driver is modified by the effect of the cutting force, and both the force-responsive signal and the reference signal, with necessary phase control, are derived therefrom.

12. Apparatus according to claim 11, in which the force applied to said moving part is controlled by controlling the amplitude of the ultrasonic vibration and wherein said ultrasonic driver comprises a piezo actuator.

13. Apparatus according to claim 1, in which the force applied by the force-applying member is controlled by controllably displacing the force applying member.

14. Apparatus according to claim 1, in which the moving part is a web carried by a rotating drum having a number of circumferentially spaced parts for cutting the web in cooperation with the force-applying member, and including an electronic control circuit comprising said lock-in amplifier, wherein said control circuit controls the position of the force-applying member with respect to each of the said circumferentially spaced parts of the drum.

15. Apparatus for periodically applying a controllable force to a moving part, said apparatus comprising:

a force-applying member;

an ultrasonic driver which is responsive to an ultrasonic drive signal to cause ultrasonic vibration of said force-applying member whereby said force-applying member periodically applies a force to said moving part; and a control circuit which derives a force-affected signal and a reference signal from said drive signal and comprises a lock-in amplifier which receives said force-affected signal and reference signal and produces an output signal which is used to control the force applied by said force-applying member, said lock-in amplifier operating to substantially eliminate or reduce any noise element in said force-affected signal.

* * * * *